United States Patent [19]

Howey

[11] 4,318,432

[45] Mar. 9, 1982

[54] WORKBENCH TOOL ASSEMBLY

[76] Inventor: Thomas L. Howey, 1678 Hooker Oak Ave., Chico, Calif. 95926

[21] Appl. No.: 154,814

[22] Filed: May 30, 1980

[51] Int. Cl.[3] ..... B27C 9/04

[52] U.S. Cl. ..... 144/1 C; 144/35 R; 29/560; 408/235; 408/236

[58] Field of Search ..... 144/1 R, 1 C, 1 D, 1 G, 144/35 R, 3 R; 408/234, 235, 236; 409/237; 29/560

[56] References Cited

U.S. PATENT DOCUMENTS

| | | | |
|---|---|---|---|
| 1,695,493 | 12/1928 | Holmes | 408/236 X |
| 2,619,135 | 11/1952 | Callaway | 144/1 C |
| 2,662,566 | 12/1953 | Kurschner | 144/1 R |
| 2,835,289 | 5/1958 | Rockwell | 144/1 C |
| 2,927,612 | 3/1960 | Edgemond, Jr. et al. | 144/1 C |
| 3,124,178 | 3/1964 | Packard | 144/1 C |
| 3,299,918 | 1/1967 | Howey | 144/1 C |
| 3,387,638 | 6/1968 | West | 144/1 C |
| 3,456,699 | 7/1969 | Taylor | 144/1 R |
| 3,815,647 | 6/1974 | Piemont | 144/1 C |

FOREIGN PATENT DOCUMENTS

| | | | |
|---|---|---|---|
| 941223 | 7/1948 | France | 144/1 C |
| 686994 | 2/1953 | United Kingdom | 144/1 C |

*Primary Examiner*—W. D. Bray
*Attorney, Agent, or Firm*—Jack C. Munro

[57] ABSTRACT

A workbench tool assembly which takes the form of a frame upon which is mounted a drill press assembly movable between a stored position within the frame and an extended position above the frame. The drill press assembly includes a counterbalance mechanism to counterbalance the force required to move the drill press assembly between the retracted position and the extended position. The workbench tool assembly also includes a table saw assembly and a separate band saw assembly, as well as a jointer, a sander and a lathe.

9 Claims, 6 Drawing Figures

WORKBENCH TOOL ASSEMBLY

BACKGROUND OF THE INVENTION

The field of this invention relates to a home workshop which is constructed of a plurality of different wood working tools mounted on a single frame. The subject matter of this invention is deemed to be an improvement over U.S. Pat. No. 3,299,918, entitled MACHINE SHOP CONSTRUCTION, issued Jan. 24, 1967, by the present inventor While there have been known different types of workshop units, it is not believed that there has been such a unit which is as versatile as the present invention, which permits a substantial number of different wood working operations to be performed and which can be manufactured at a most reasonable cost.

SUMMARY OF THE INVENTION

The workbench tool assembly of this invention is constructed of a frame. Attached to the upper surface of the frame is a drill press assembly. The drill press assembly is to be movable between a retracted position located substantially within or along the top surface of the frame to an extended position located substantially at a right angle to the top surface. A counterbalance means in the form of a spring assembly is connected between the frame and the drill press assembly which requires that only a small amount of force be used to move the drill press assembly between the extended and the retracted position. On one side of the frame is mounted a table saw assembly. The table saw assembly is tiltable with respect to the frame to various inclined positions so as to facilitate sawing of elongated workpieces. Also, a separate band saw assembly is mounted on the opposite side of the frame. Additionally, the frame has mounted thereon a jointer, a sander, and a lathe. The drill press assembly is to include a handle ratchet mechanism which is to be used in moving the drill bit toward and away from the workpiece supporting table of the drill press assembly.

DETAILED DESCRIPTION OF THE SHOWN EMBODIMENT

Figure 1:
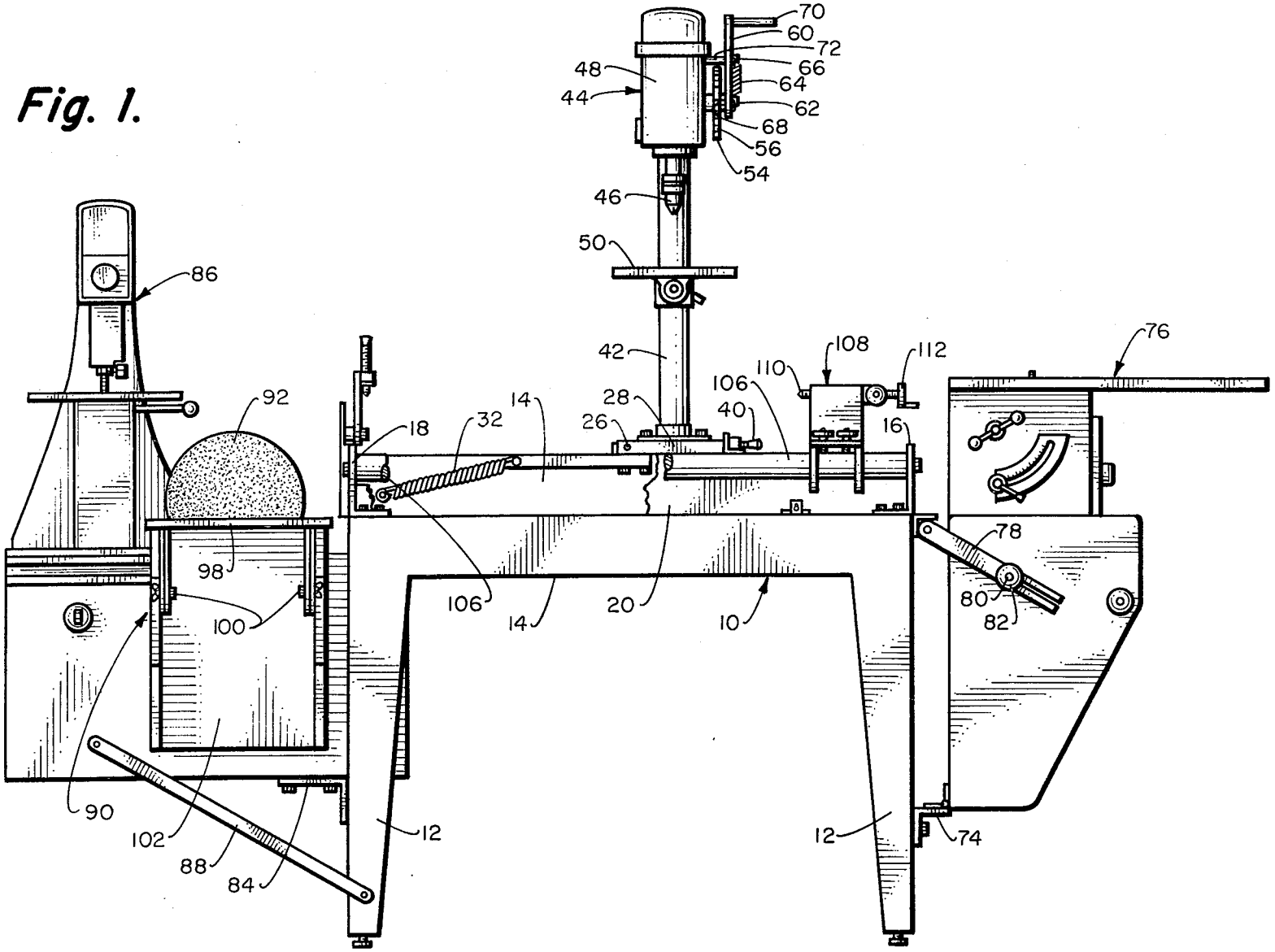
FIG. 1 is a front elevational view of the workbench tool assembly of this invention showing the drill press assembly in an extended position.

The present invention relates to a structure which combines several different wood working pieces of equipment into a single unit. The invention has to do with the combining of the separate pieces of equipment and does not have to do with the construction of the individual pieces of equipment themselves. Actually, each wood working piece of equipment is deemed to be conventional and forms no specific part of this invention.

Although the present invention is discussed in terms of wood working pieces of equipment, it is considered to be within the scope of this invention that these pieces of equipment could perform operations on materials other than wood, such as plastic or metal, without departing from the scope of this invention.

Referring particularly to the drawings, there is shown a metal frame 10 which has four in number of legs 12 which are to be located upon a supportive surface, such as a floor. The upper end of the legs 12 are connected together by connecting members 14. The connecting members 14 (four in number) combine to form the top surface of the frame 10. Also, the frame 10 has a right side, a left side, a front and a back. The members 14 are connected at their sides by means of side plates 16 and 18. Side plate 16 is at the right side and side plate 18 is at the left side. Located between the side plates 16 and 18 and fixedly attached thereto and also parallel to the members 14, is a third member 20. The third member 20 is located in between the longest pair of members 14.

Figure 4:
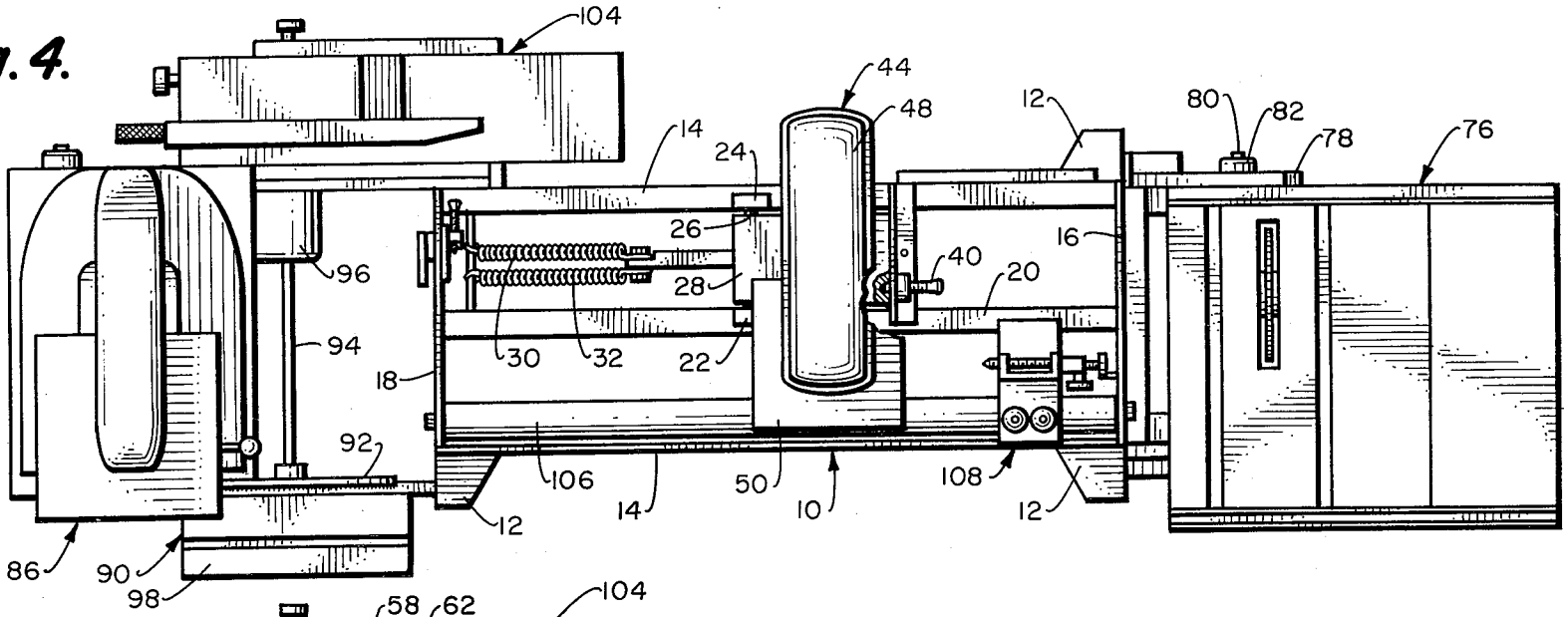
FIG. 4 is a top plan view of the workbench tool assembly of this invention with the drill press in the extended position.
Figure 5:
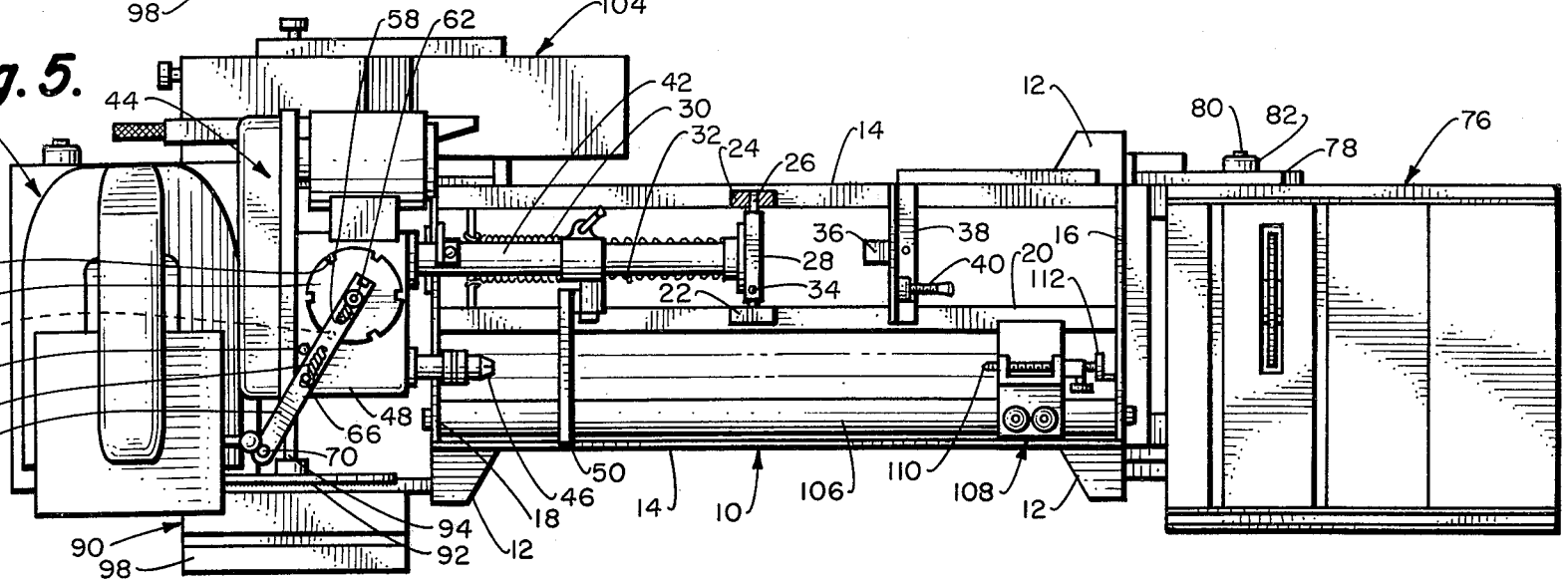
FIG. 5 is a view similar to FIG. 4 but with the drill press assembly in the retracted position.
Figure 6:
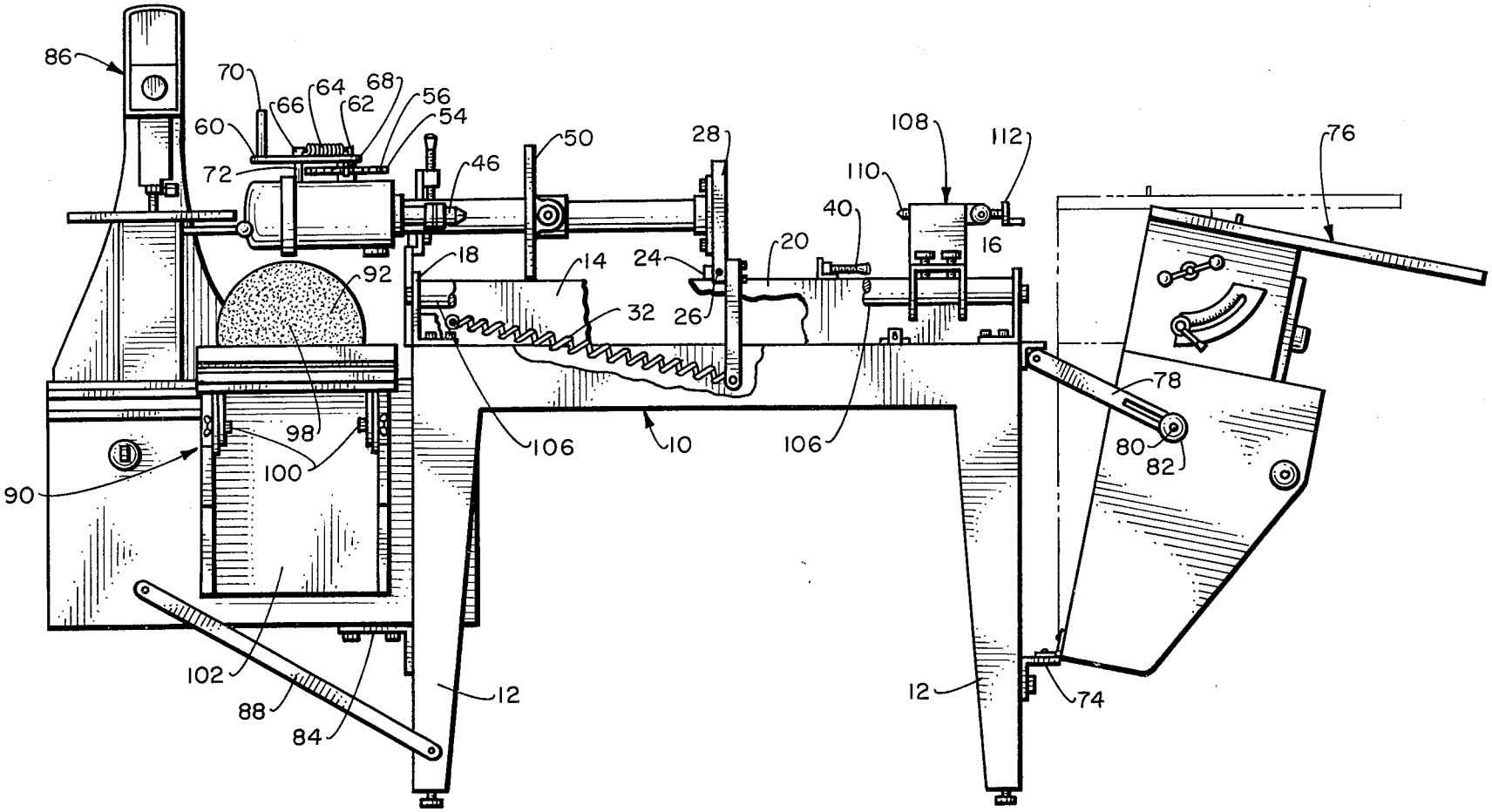
FIG. 6 is a view similar to FIG. 1 but with the drill press in the retracted position.

Mounted on member 20 is a first bearing assembly 22. A second bearing assembly 24 is mounted on member 14 at the back side of the frame 10. Rotatably supported between the bearing assemblies 22 and 24 is a shaft 26. The shaft 26 is fixedly secured to a base plate 28. Fixedly secured to the left side of the base plate 28 are a pair of coil springs 30 and 32. The free ends of springs 30 and 32 are secured to a side member 14. The right side of the base plate 28 includes a hole 34. The base plate 28 is to be pivotable by means of the shaft 26 with respect to the frame 10. The retracted position is shown in FIG. 5 with the base plate 28 assuming a substantially vertical position in respect to the top surface of the frame 10. The extended position is shown in FIG. 4 wherein the plate 28 comes to rest against horizontal flange 36 of a cross member 38. The cross member 38 is fixedly secured between members 14 and 20. Mounted within the cross member 38 is a threaded bolt 40. The threaded bolt 40 is to be extendable within the hole 34 when the base plate 28 is in the extended position.

Fixedly mounted onto the base plate 28 is a stanchion 42. The stanchion 42 is part of the drill press structure 44. The drill press structure 44 is deemed to be conventional and forms no specific part of this invention. Basically, the drill press structure includes a rotatable chuck 46, which is to contain a drill bit (not shown), which is to be movable in respect to the drill press housing 48. The movement of the chuck 46 is toward and away from workpiece supporting table 50. The table 50 is attached to the stanchion 42 and is capable of being adjusted to various inclined positions in respect thereto, as well as being rotated about the stanchion 42 if desired.

The movement of the chuck 46 in respect to the table 50 is accomplished through a gearing arrangement (not shown) located within the housing 50. The gearing arrangement is connected to the shaft 52. The shaft 52 is fixedly attached to a ratchet wheel 54. The ratchet wheel 54 has a plurality of spaced apart notches 56 (preferably six in number) located within the periphery of the wheel 54. The outer end of the shaft passes through an elongated slot 58 within an arm 60. A fastening device 62 connects with the end of the shaft 52 holding the arm 60 adjacent to the wheel 54. The shaft 52 is rotatable with respect to the arm 60. A coil spring 64 is connected between pin 66 mounted on the arm 60 and the shaft 52. On the back side of the arm 60 there is mounted a locating pin 68. The spring 64 exerts a continuous bias on the arm 60 tending to locate the locating pin 68 within one of the notches 66. When such is the case, the operator is to grasp handle 70 mounted on the outer end of the arm 60 and pivot such downward toward the frame 10 which also causes similar movement of the chuck 46 toward the workpiece table 50.

Figure 3:
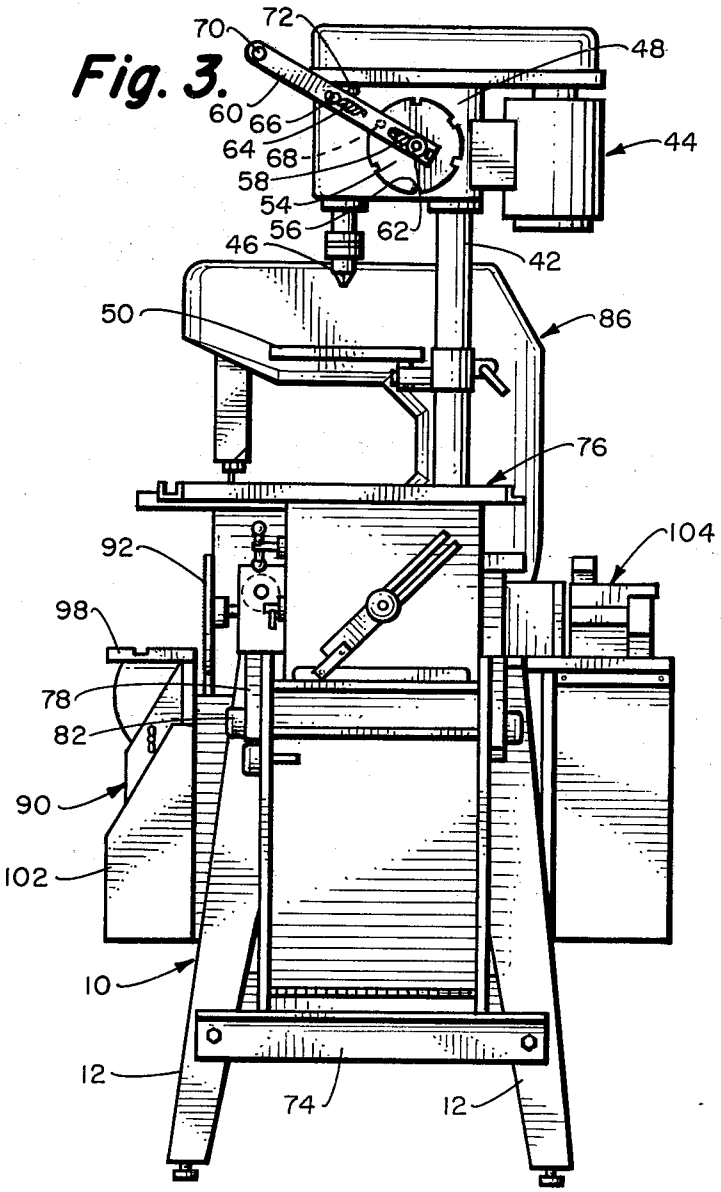
FIG. 3 is a right side view of the workbench tool assembly shown within FIG. 1.
Figure 2:
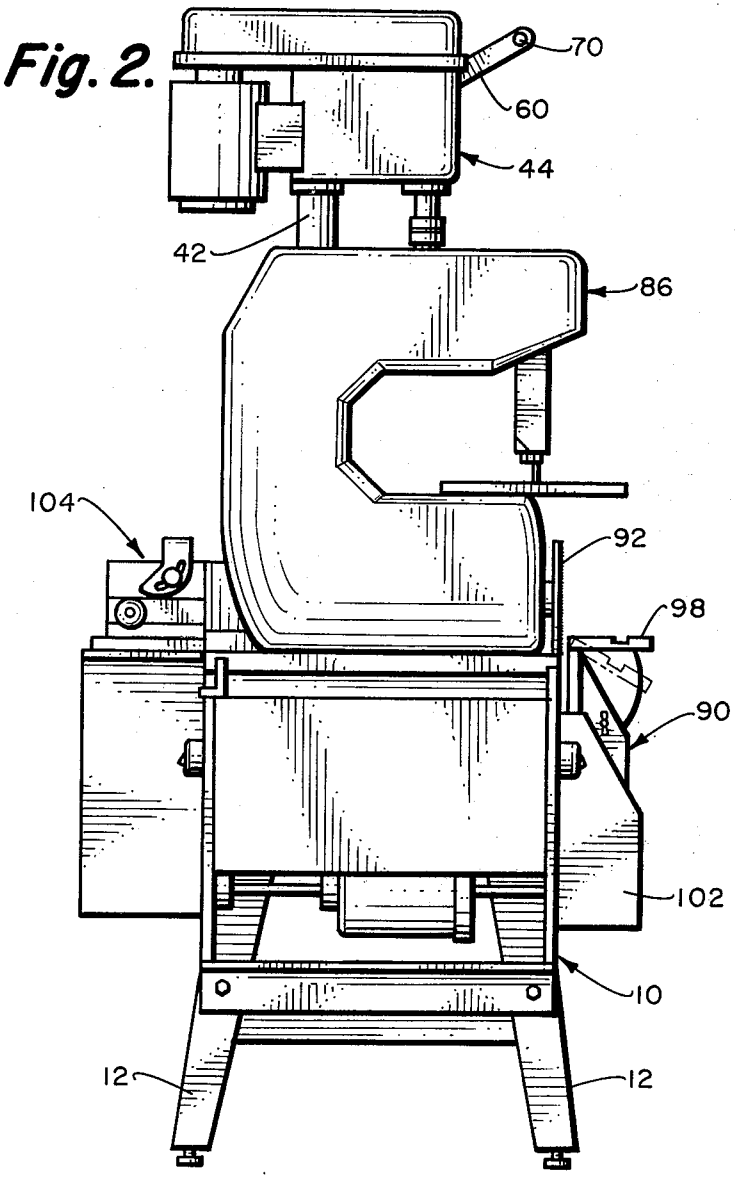
FIG. 2 is a left side view of the workbench tool assembly shown within FIG. 1.

The purpose of this just described ratcheting arrangement is for minimizing dead travel of the chuck 46 in respect to the workpiece which will be mounted on the workpiece supporting table 50. In other words, initially, the operator is to exert an outward pull on the arm 60 disengaging the locating pin 68 from a notch 56. The operator is then free to manually rotate the wheel 54 until the chuck 46 is in its desired position, normally just adjacent the workpiece (not shown) which is mounted on the workpiece supporting table 50. It is to be understood that there will be some form of a rotating tool, such as a drill bit within the chuck 46, and it is actually the drill bit that is to be positioned directly adjacent the workpiece. The operator then places the arm 60 in the position shown within FIG. 3 of the drawings and releases the arm 60 which causes the spring 64 to move the locating pin 68 into one of the notches 56. The natural tendency of the chuck 46 is to retract to its uppermost position. However, this is now prevented since the locating pin 68 connects with a notch 56. The arm 60 abuts a stop pin 72 which is mounted on the housing 48 which limits the upward travel of the arm 60.

It is to be understood that the drill press structure 44 is to be movable between the retracted position shown within FIG. 5 to the extended or operating position shown within FIG. 4. The weight of the drill press structure 44 is counterbalanced by the bias of the springs 30 and 32. In other words, only a small amount of force is required to effect movement of the drill press structure 44 between the retracted and extended position. It is to be understood that with the drill press structure 44 in the retracted position that other pieces of wood working equipment mounted on the frame 10 can be utilized without the drill press structure 44 hindering these operations. It is to be understood that when the drill press structure 44 is in the retracted position that the work piece supporting table 50 can be loosened with respect to the stanchion 42 and moved to a non-interfering position.

Hingedly mounted on the right side of frame 10 by means of hinge bracket 74 is a table saw assembly 76. The table saw assembly is deemed to be conventional and includes a saw blade which is rotatable driven by a motor (not shown). Also, a motor mechanism is included with respect to the drill press structure 44 and to operate the chuck 46. The flat table surface of the table saw assembly 76 is located a predetermined distance above the top surface of the frame 10. This height is preselected so as to permit table saw assembly 76 to perform operations on large pieces of wood without the interference by the retracted drill press structure 44. Also, if necessary, the entire table saw assembly can be tilted to an inclined position and fixed in that position by means of arm 78 which cooperates with a bolt 80 mounted on the drill press structure 76. The arm 78 is pivotally connected to the frame 10. A knob 82 is threadably connected to the bolt 80 and is to be tightened against the arm 78 thereby fixedly securing the table saw assembly in an established inclined position.

On the left side of the frame 10, there is fixedly mounted by means of a bracket 84, a band saw assembly 86. The bracket 84 connects the band saw assembly 86 to the pair of legs 12 on the left side of the frame 10. A pair of brace arms 88 are connected between the band saw assembly 86 and the legs 12 in order to stabilize the mounting of the band saw assembly 86.

Also mounted on the left side and adjacent the front side of the frame 10 is a disc sander assembly 90. The disc sander assembly 90 includes a rotatable sanding disc 92 which is rotated by means of shaft 94. The shaft 94 is rotatably driven from the motor 96. The disc sander 92 is located directly adjacent the housing of the band saw assembly 86. A shelf 98 is mounted directly adjacent the disc 92. The shelf 98 is hingedly mounted by means of fasteners 100 in respect to a channel shaped base 102. The base 102 is fixedly secured to the housing of the band saw assembly 86. The purpose for the hingedly mounting of the shelf 98 is so that the shelf 98 can be slanted in respect to the disc 92. This means that the sanding operation with respect to the disc 92 can be accomplished in other than directly into the disc 92.

A jointer assembly 104 is also fixedly mounted to the left side of the frame 10 adjacent the back side of the frame 10. The jointer is also to be driven by the motor 96. Again, the jointer mechanism is deemed to be conventional and forms no specific part of this invention.

Located within the top surface of the frame 10 adjacent the front side thereof is a longitudinal bar 106. The bar 106 is connected between side plates 16 and 18. Mounted on the right side of the bar 106 is a first lathe bracket assembly 108. Lathe bracket assembly 108 includes an engaging rod 110 which is to be moved relative to the bracket assembly 108 by means of crank wheel 112. A second lathe bracket assembly is not shown but is mounted within the chuck 46. With the drill press 44 in the retracted position the location of the chuck 46 is in alignment with the longitudinal center axis of rod 110. It is to be understood that the table 50 is moved to not interfere with the operation of the lathe. The bracket assembly 108 can be moved upon the rod 106 and fixedly positioned where desired by appropriate fastening means included within the bracket assembly. Also, the bracket assembly 108 can be removed from bar 106 and stored away so that this assembly will not interfere in the use of other pieces of equipment. An elongated workpiece (not shown) is to be mounted and clamped between the rod 110 and the second assembly and tightly secured there between. Operating of the drill or press motor will then cause the workpiece to be rotated. The workpiece will rotate freely with respect to rod 116. During rotation of the workpiece, a cutting tool is to be located against the workpiece and therefore function as a lathe.

What is claimed is:

1. A workbench tool assembly comprising:

a frame having a front and a back and a right side and a left side forming a top surface, said frame being adapted to be located on a planar supportive surface;

a drill press assembly mounted on said top surface, said drill press assembly being pivotable between a retracted position and an extended position, said extended position being when said drill press assembly extends outwardly from said top surface, said retracted position being when said drill press assembly is located entirely along said top surface, said extended position being approximately ninety degrees displaced from said retracted position; and counterbalance means connected between said frame and said drill press assembly, said counterbalance means located entirely below said top surface, said counterbalance means substantially balancing said drill press assembly during the entire path of movement between said retracted position and said extended position.

2. The workbench tool assembly as defined in claim 1 wherein:

said drill press assembly includes a chuck spaced from a table, said chuck mounted on a stanchion, said table being mounted on said stanchion, said chuck being movable by movement means toward and away from said table, said movement means comprising a handle assembly, said handle assembly including an elongated handle member which is manually movable between a first position and a second position, said second position being when said chuck is located nearest said table, said first position being when said chuck is located farthest from said table, said handle member being connected with a ratchet wheel, said ratchet wheel being connected to said chuck, rotation of said ratchet wheel moves said chuck between said first position and said second position; and engagement means located between said ratchet wheel and said handle member, said ratchet wheel also being rotatable with respect to said handle member and also being fixable at a particular desired position in respect thereto by said engagement means.

3. The workbench tool assembly as defined in claim 2 including:

a table saw assembly attached to said right side, said table saw assembly including tilting means for moving and fixing said table saw assembly at various inclined positions in respect to said frame.

4. The workbench tool assembly as defined in claim 3 including:

a band saw assembly attached to said left side of said frame.

5. The workbench tool assembly as defined in claim 4 including:

a sander mounted on said left side.

6. The workbench tool assembly as defined in claim 5 wherein:

said sander having a workpiece supporting table, said workpiece supporting table of said sander being tiltable to various positions in respect to said sander.

7. The workbench tool assembly as defined in claim 6 including:

a jointer mounted on said left side, a single motor means being employed to operate both said sander and said jointer.

8. The workbench tool assembly as defined in claim 7 including:

a lathe assembly mountable on said top surface, said lathe assembly to be usable when said drill press assembly is in said retracted position.

9. The workbench tool assembly as defined in claim 8 wherein:

said counterbalance means comprises a coil spring assembly.

* * * * *